United States Patent [19]

Oikawa

[11] 4,147,496

[45] Apr. 3, 1979

[54] SAFETY IGNITION MEANS FOR BURNER INSTALLATIONS

[75] Inventor: Satoshi Oikawa, Kawasaki, Japan

[73] Assignee: Robertshaw Controls Company, Richmond, Va.

[21] Appl. No.: 837,600

[22] Filed: Sep. 28, 1977

[30] Foreign Application Priority Data

May 2, 1977 [JP] Japan ..... 52-56553[U]

[51] Int. Cl.[2] ..... F23Q 9/14

[52] U.S. Cl. ..... 431/43; 431/42; 431/51

[58] Field of Search ..... 431/42, 43, 45, 46, 431/51

[56] References Cited

U.S. PATENT DOCUMENTS

| | | | |
|---|---|---|---|
| 2,800,176 | 7/1957 | Morrison | 431/45 |
| 2,981,324 | 4/1961 | Deziel | 431/46 |
| 4,073,611 | 2/1978 | Kaduki et al. | 431/45 |

*Primary Examiner*—Carroll B. Dority, Jr.
*Attorney, Agent, or Firm*—Fulwider, Patton, Reiber, Lee & Utecht

[57] ABSTRACT

Safety ignition means for burner installations having a first solenoid operated valve for a pilot burner, a second solenoid operated valve for a main burner, and an electric heater for igniting the pilot burner. The first valve has a hold solenoid connected to a power source through a normally closed bimetal switch. The first valve also has a make solenoid connected parallel to the hold solenoid through a flame switch and a second electric heater for the bimetal switch. The second valve has a solenoid connected parallel to the hold solenoid of the first valve through the flame switch. The flame switch is operative in response to flame of the pilot burner to deenergize the second electric heater for the bimetal switch and the make solenoid of the first valve and energize the solenoid of the second valve.

6 Claims, 2 Drawing Figures

SAFETY IGNITION MEANS FOR BURNER INSTALLATIONS

Figure 1:
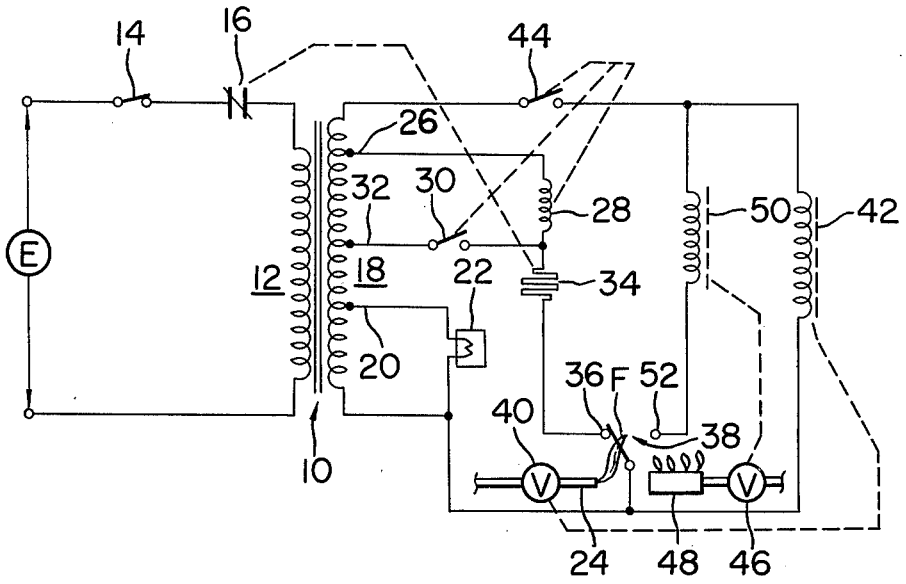

This invention relates to safety ignition means for burner installations, and more particularly to an improved safety ignition means for gas burner installations of the type in which, upon turning an ignition switch on, an igniting means and a first solenoid operated valve are energized to ignite a pilot burner, and thereafter, a flame switch in response to the pilot burner flame energizes a second solenoid operated valve so that a main burner is ignited by the pilot burner.

Ignition failure or extinguishment in gas appliances may lead to serious accidents endangering human life. In order to prevent such accidents, various safety ignition means for gas burner installations have heretofore been proposed and used. However, they have been complicated, and have not been sufficiently reliable in coping with ignition failure or extinguishment in gas burner installations.

It is therefore an object of this invention to provide a new and improved safety ignition means for gas burner installations in which the above mentioned defects are eliminated.

Another object of this invention is to provide a safety ignition means for burner installations, which has a simple construction and acts to hold the solenoid operated valve means for the main burner means in a closed condition unless the pilot burner means is ignited.

A further object of this invention is to provide a safety ignition means for burner installations, which is of simple construction and is adapted to be separated as a whole from a power source when the burner means is not ignited even after lapse of a predetermined period of time from initiation of the burner ignition means.

The above and other objects of this invention will be accomplished by safety ignition means for burner installations according to this invention, which comprises pilot igniting means, first solenoid operated valve means for pilot burner means and second solenoid operated valve means for main burner means. Flame switch means is provided which is responsive to flame of the pilot burner means to energize the second solenoid operated valve means so as to ignite the main burner means. Timer means is connected in series with the flame switch means so as to operate delay operating switch means between a power source and the burner ignition means. If no flame is detected by the flame switch means, the timer means continues to be energized through the flame switch means. When such a condition exceeds a predetermined period of time, the delay operating switch means is opened by the timer means to separate the overall ignition means from the power source.

In one embodiment of this invention, the pilot igniting means is ceaselessly in an energized condition after initiation of the ignition means. Therefore, even if the burner means should be extinguished by some cause during the burning operation of the burner installations, re-ignition is made. If the re-ignition is not made within a short time, the timer means is energized by the action of the flame switch means so as to open the delay operating switch means after lapse of the predetermined period of time, whereby the overall ignition means is disconnected from the power source. In one specific embodiment of this invention, the delay operating switch is a bimetal switch and the timer means is an electric heater for heating the bimetal switch.

Figure 2:
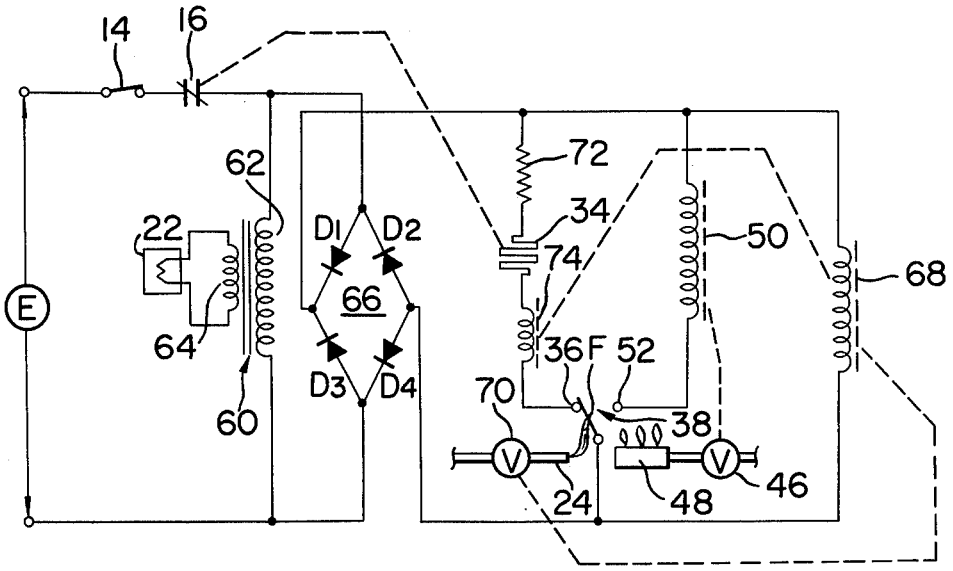

The above and other objects and effects of this invention will become apparent from the following description of preferred embodiments of this invention with reference to the accompanying drawings, in which:

FIG. 1 is an electric circuit diagram showing an embodiment of the burner safety ignition means according to this invention; and FIG. 2 is a view similar to FIG. 1, but showing another embodiment of the burner safety ignition means according to this invention.

Referring to FIG. 1, there is shown burner safety ignition means according to this invention in the form of a circuit diagram. The burner safety ignition means comprises a transformer 10 having a primary winding 12 connected across a power source E through a thermostat 14 and a normally closed delay operating switch such as a bimetal switch 16. The thermostat 14 is, for instance, assembled in a temperature controller for a boiler or the like and is adapted to be opened and closed for temperature control.

The secondary winding 18 of the transformer 10 has a first tap 20 connected to pilot igniting means 22 such as an electric heater for igniting a pilot burner 24. The secondary winding 18 also has a second tap 26 connected to one end of a relay 28. The relay 28 has a first normally opened relay switch 30 connected between the other end of the relay 28 and a third tap 32 of the secondary winding so as to form a self-hold circuit. The relay 28 is also connected at the other end thereof through timer means 34 for the delay operating switch 16 to one stationary contact 36 of a flame switch 38. The timer means 34 may, for example, be an electric heater for heating the bimetal switch 16.

A first solenoid operated valve 40 is provided for the pilot burner 24 and has a solenoid 42 connected across the secondary winding 18 of the transformer 10 through a second normally opened relay switch 44 of the relay 28. A second solenoid operated valve 46 is provided for a main burner 48 and has a solenoid 50 connected in parallel with the solenoid 42 of the first valve through the other stationary contact 52 of the flame switch 38.

The flame switch 38 has a heat-sensitive section disposed in the vicinity of the pilot burner 24 and is adapted to move its movable contact from the one contact 36 to the other contact 52 when the heat-sensitive section is heated by the flame F of the pilot burner 24. The flame switch is well-known to persons skilled in the art, and therefore, detailed description will be omitted here. FIG. 1 shows the state in which the flame switch has not yet been sufficiently heated by the flame of the pilot burner. The flame switch is switched to the contact 52 when sufficiently heated.

The bimetal switch 16 is adapted such that when the heating of the bimetal by the heater 34 exceeds a predetermined period of time, the bimetal heat-deforms to open the switch. Once opened, the bimetal switch 16 is also adapted to be closed only by operation of a reset button (not shown).

The burner safety ignition means described above operates in the following way. When the thermostant 14 is closed, the primary winding 12 of the transformer 10 is energized through the bimetal switch 16, whereby all the circuit elements excluding the solenoid 50 of the solenoid operated valve 46 for the main burner 48 are energized. As will be apparent from FIG. 1, the igniting heater 22 for the pilot burner 24 continues to be energized while the transformer 10 is energized. When the relay switch 44 is closed due to energization of the relay 28, the solenoid 42 is energized to open the solenoid operated valve 40 for the pilot burner 24, whereby the pilot burner is ignited by the pilot burner igniting heater 22. When the heat-sensitive section of the flame switch 38 is heated by the flame of the pilot burner, the flame switch is switched from the contact 36 to the contact 52. As a result, the heater 34 for the bimetal switch 16 is de-energized but the relay switch 44 is held in the closed condition since the relay is self-held by the relay switch 30. At the same time, the solenoid 50 is energized to open the solenoid operated valve 46 for the main burner 48, whereby the main burner 48 is ignited by the pilot burner 24. The above is the normal ignition operation.

In the above igniting operation, if the pilot burner 24 fails to ignite or is extinguished due to some cause, since the heat source 22 continues to be energized, igniting operation continues so that re-ignition is made. If the pilot burner 24 is still not ignited, the flame switch 38 is not heated, and consequentially is not switched to the contact 52, whereby the solenoid 50 of the main burner valve 48 is not energized. Thus, the main burner valve remains closed. When the pilot burner 24 is still not ignited by the continuously energized heater 22, the heater 34 for the bimetal switch is energized during this period of time. If the heating of the bimetal switch 16 exceeds a predetermined period of time, the bimetal switch 16 is opened to separate the entire circuit of the ignition means from the power source, thereby de-energizing the solenoid 42 so as to allow the pilot burner valve to be returned to the closed condition. Thus, there is no possibility of a considerable amount of non-combusted gas being discharged as it is at the time of burner ignition failure.

Even though the pilot burner 24 is extinguished by some cause during the burning operation of the burner, re-ignition is made since the heater 22 remains energized. However, if re-ignition is not obtained in a short time so that the heat-sensitive section of the flame switch 38 is cooled down, the flame switch 38 is returned from the contact 52 to the contact 36, whereby the solenoid 50 is de-energized to allow the main burner valve 46 to be returned to the closed condition. Thereafter, if the pilot burner is re-ignited, the flame switch is switched again to the contact 52, so that the main burner is re-ignited. On the other hand, if re-ignition is not obtained, the bimetal switch 16 is opened as in the previous case, thereby separating the ignition means from the power source and rendering all of the solenoid operated valves closed.

Now, referring to FIG. 2, there is shown another embodiment of the burner ignition means according to this invention. In FIG. 2, circuit elements identical to those in FIG. 1 are designated by the same reference numerals. This burner ignition means includes a transformer 60 having a primary winding 62 connected across a power source E through a thermostat 14 and a bimetal switch 16. Across the secondary winding 64 of the transformer 60 is connected a heater 22 for igniting a pilot burner 24. Parallel to the primary winding 62 of the transformer 60, is connected a diode bridge 66 consisting of diodes $D_1$, $D_2$, $D_3$ and $D_4$ connected as shown in FIG. 2. Across output terminals of the diode bridge 66 is connected a hold solenoid 68 of a solenoid operated valve 70 for the pilot burner 24. Parallel with the hold solenoid is connected a series connection consisting of a resistor 72, a heater 34 for the bimetal switch 16 and a make solenoid 74 of the pilot burner valve 70, through a flame switch 38. A solenoid 50 of a main burner valve 46 is connected at its one end to one of the output terminals of the diode bridge 66 and at its other end to a stationary contact 52 of the flame switch 38.

The hold solenoid 68 and the make solenoid 74 for the pilot burner valve 70 are designed such that they produce sufficient magnetic flux to close the valve 70 when both of them are simultaneously energized and that the valve 70 is held in the closed condition, so long as the hold solenoid is energized. But, the solenoid operated valve 70 is in no event brought into the closed condition by energizing only either of the hold solenoid 68 and the make solenoid 74, and the energization of only the make solenoid does not maintain the valve 70 in the closed condition.

This embodiment operates as follows. When the thermostat 14 is closed, the heat source 22 for ignition of the pilot burner 24 is energized and the hold solenoid 68 and the make solenoid 74 for the pilot burner valve 70 are at the same time energized to open the valve 70, so that the pilot burner 24 is ignited by the igniting heater 22. With the ignition of the pilot burner 24, the heat-sensitive section of the flame switch 38 is heated to switch the movable contact from the contact 36 to the contact 52. Consequentially, the heater 34 and the make solenoid 74 is de-energized, but since the hold solenoid 68 continues to be energized, the pilot burner valve 70 is still in the opened condition. On the other hand, the solenoid 50 is energized to open the main burner valve 46 whereby the main burner 48 is ignited by the pilot burner 24. This is the normal ignition operation.

If the burner installation is not ignited in the ignition operation or is extinguished during operation of the burner installation, the ignition operation is repeated by cooperation of the continuously energized heater 22 and the pilot burner 24. Nevertheless, if ignition is not attained by this operation, the flame switch 38 is kept in or returned back to the closed condition and consequentially the bimetal switch 16 is opened by heat from the associated heater 34, thereby separating the ignition means from the power source. In this way, the emission of non-cumbusted gas during ignition failure or extinguishment of the main burner is prevented.

Since the pilot burner valve is adapted to be opened only when both of the make solenoid and the hold solenoid are energized and since the solenoid of the main burner valve is adapted to be energized only after the ignition of the pilot burner, safety against internal troubles of ignition means such as disconnection of the circuit is ensured and safety of opening and closing the solenoid operated valves for the main burner and pilot burner is further enhanced.

As seen from the above, the safety ignition means for burner installations according to this invention is of simple construction and provides sufficient degree of safety against various troubles including those attributable to internal factors and external factors.

It should be understood that various changes and modifications may be made without departing from the scope and spirit of this invention.

I claim:

1. Safety ignition means for burner installations comprising a transformer having a primary winding adapted to be connected to a power source; a normally closed delay operating switch connected between the power source and said transformer; means connected to a secondary winding of said transformer for igniting pilot burner means; relay means connected to said secondary winding of said transformer through timer means and flame switch means, said relay means having a normally opened relay switch connected between a tap of said secondary winding and said relay means for self-hold of said relay; said timer means being associated with said delay operating switch and being operative, when said timer means is continuously energized above a predetermined period of time, to open said delay operating switch; first solenoid operated valve means for the pilot burner means and having a solenoid connected across said secondary winding of said transformer through a second normally opened relay switch of said relay means; and second solenoid operated valve means for main burner means and having a solenoid connected parallel with said solenoid of said first valve means through said flame switch means; said flame switch means being operative in response to the pilot burner flame to deenergize said timer means and energize said solenoid of said second solenoid operated valve, whereby, when no burner flame is established within said predetermined period of time, said delay operating switch is opened by said timer means so as to separate the ignition means from the power source.

2. Safety ignition means according to claim 1 in which said delay operating switch is a bimetal switch and said timer means is a heat source for heating said bimetal switch.

3. Safety ignition means for burner installations comprising a normally closed delay operating switch connected between the ignition means and a power source; heat source means connected through said delay operating switch to the power source for igniting pilot burner means; first solenoid operated valve for the pilot burner means and having a make solenoid and a hold solenoid, said hold solenoid of said first valve being connected through said delay operating switch to the power source; timer means connected parallel with said hold solenoid through said make solenoid of said first valve and flame switch means; said timer means being associated with said delay operating switch and operative, when said timer means is continuously energized above a predetermined period of time, to open said delay operating switch; and second solenoid operated valve for main burner means and having a solenoid connected parallel with said hold solenoid of said first valve through said flame switch means; said flame switch means being operative in response to the pilot burner flame to deenergize said timer means and energize said solenoid of said second valve, whereby, when no burner flame is established above said predetermined period of time, said delay operating switch is opened by said timer means so as to separate the ignition means from the power source.

4. Safety ignition means according to claim 3 in which said delay operating switch is a bimetal switch and said timer means is a heat source for heating said bimetal switch.

5. Safety ignition means according to claim 3 in which said heat source is connected to the power source through a transformer.

6. Safety ignition means according to claim 3 further including diode bridge means connected at input terminals thereof to the power source through said delay operating switch and at output terminals thereof to said hold solenoid of said first valve.

* * * * *